US006116987A

United States Patent [19]

Kubo

[11] Patent Number: 6,116,987

[45] Date of Patent: Sep. 12, 2000

[54] METHOD OF POLISHING HARD DISC AND POLISHING APPARATUS THEREFOR

[76] Inventor: Yuzo Kubo, 1-22, Tachibana-dori Nishi 4-chome, Miyazaki-shi, Miyazaki, Japan

[21] Appl. No.: 09/125,665

[22] PCT Filed: Feb. 28, 1997

[86] PCT No.: PCT/JP97/00633

§ 371 Date: Aug. 19, 1998

§ 102(e) Date: Aug. 19, 1998

[87] PCT Pub. No.: WO97/32691

PCT Pub. Date: Sep. 12, 1997

[30] Foreign Application Priority Data

Mar. 4, 1996 [WO] WIPO ..... PCT/JP96/00517

[51] Int. Cl.[7] ..... B04B 1/00

[52] U.S. Cl. ..... 451/41; 451/63; 451/264; 451/274; 451/283

[58] Field of Search ..... 451/41, 63, 285–289, 451/488, 449, 456, 274, 259, 264, 269, 278, 283, 411, 413

[56] References Cited

U.S. PATENT DOCUMENTS

| | | | |
|---|---|---|---|
| 3,863,397 | 2/1975 | Reitz | 451/283 |
| 4,393,628 | 7/1983 | Ottman et al. | 451/63 |
| 5,099,618 | 3/1992 | Schmid | 451/63 |
| 5,542,874 | 8/1996 | Chikaki | 451/289 |
| 5,674,115 | 10/1997 | Yamashita et al. | 451/63 |
| 5,738,568 | 4/1998 | Jurjevic et al. | 451/41 |
| 5,791,976 | 8/1998 | Honda | 451/41 |
| 5,816,895 | 10/1998 | Honda | 451/41 |
| 5,871,392 | 2/1999 | Meikle et al. | 451/56 |

FOREIGN PATENT DOCUMENTS

| | | |
|---|---|---|
| 56-157949 | 12/1981 | Japan . |
| 57-202651 | 12/1982 | Japan . |
| 59-76764 | 5/1984 | Japan . |
| 59-182057 | 10/1984 | Japan . |
| 59-182058 | 10/1984 | Japan . |
| 60-4344 | 1/1985 | Japan . |
| 62-141451 | 9/1987 | Japan . |
| 63-22257 | 1/1988 | Japan . |
| 63-150147 | 6/1988 | Japan . |
| 1-79553 | 5/1989 | Japan . |
| 2-199832 | 8/1990 | Japan . |
| 4-201178 | 7/1992 | Japan . |
| 6-114701 | 4/1994 | Japan . |

*Primary Examiner*—David A. Scherbel
*Assistant Examiner*—George Nguyen
*Attorney, Agent, or Firm*—Muramatsu & Associates

[57] ABSTRACT

A method and apparatus for polishing hard discs uniformly while minimizing frictional electricity between the discs and polishing materials as well as preventing from frictionally heated deformation. A turntable for placing a disc thereon is freely rotatable without being connected to any motor or other driving force. A polishing material rotates horizontally and polishes the surface of the disc by contacting with the surface. The turntable relatively slides against the surface of the polishing material. A spindle of the polishing material is slightly inclined toward the center of the turntable from a vertical axis of the disc. The turntable is rotated in a direction opposite to the rotating direction of the disc. The rotation of the turntable is induced by the rotation of the polishing material transmitted by the friction between disc and turntable. The disc is substantially electrically connected to the ground during the polishing.

13 Claims, 6 Drawing Sheets

METHOD OF POLISHING HARD DISC AND POLISHING APPARATUS THEREFOR

FIELD OF THE INVENTION

This invention relates to methods and apparatuses for polishing hard discs including, but not limited to, resinous optical discs, lenses, and metallic discs such as silicon wafers.

BACKGROUND OF THE INVENTION

In recent years, resinous optical discs are being used for various purposes such as for music discs, CD-ROM for computers, and cinema discs. A reason for the rapid diffusion is that the memories of such discs are rarely damaged by optical reading.

However, the surface layers covering the memories are made of transparent resin. This resinous surface is easily scratched. Reading errors (eg. sound "jumping" or movement of pictures) are caused by the scratches. In order to eliminate the scratches, it is necessary to polish the surface layer.

In one typical polishing method, a polishing pad, which is used as a polishing material, contacts the surface of a disc which is to be polished (hereinafter referred to as "the surface for polishing"). The diameter of such a polishing pad is the same as the width of surface for polishing. The disc and the polishing pad are simultaneously rotated. An abrasive is poured between the polishing pad and the disc and then the disc is polished.

The above mentioned polishing methods have the following problems.

(1) Irregularities may be caused by the polishing pad which is rotating under a constant condition, since the speed of the inside of a disc is different from the speed of the outside (since the outside is faster than the inside, the inside of a disc is more difficult to polish than the outside).

(2) Static electricity is generated by the friction between the disc and a polishing pad, and then polishing-dust sticks to the surface of the disc.

(3) The disc is overheated by the frictional heat, and the disc is, then, deformed.

SUMMARY OF THE INVENTION

Accordingly, it is the object of the present invention to provide methods and apparatuses for polishing hard discs uniformly while minimizing frictional electricity between the discs and polishing materials as well as preventing, and which prevent from frictionally heated deformation of the discs occurring.

To accomplish the fore-mentioned objects of the present invention: an apparatus for polishing hard discs comprising; a rotatable turntable place a disc thereon, a polishing material which polishes the surface of the disc by contacting the disc, said polishing material rotates horizontally, a spindle of the polishing material slightly inclines toward the center of the turntable from the vertical axis of the disc. The turntable is rotated in the opposite direction to the rotating direction of the disc by the friction between the disc and the polishing material. This enables the surface of the disc to be polished uniformly.

A conductive mat is mounted on the turntable, and the turntable is essentially grounded. Static electricity, which is generated by the friction between the disc and the polishing material, is thereby eliminated, and polishing dust is prevented from sticking to the surface of the disc.

A temperature sensor which detects the temperature of the disc is provided. Temperature information is processed so that the polishing material shall be released from the disc when the disc overheats. Deformation of the disc is whereby prevented.

A porous backing pad is deposited between the polishing material and spindle, whereby frictional heat of the polishing material is discharged.

A polishing material having a diameter which is larger than the width of surface to be polished of a disc is employed. In particular, the surface to be polished is covered by a polishing material which has radius that is the same as, or larger than, the width of the surface to be polished (refer FIG. 6). The disc is rotated in the opposite direction to the rotating direction of the polishing material by the rotation of the polishing material, and then the disc is polished. Thereby the disc is stably rotated and is polished uniformly.

DETAILED DESCRIPTION OF THE PREFERRED EMBODIMENT

In the present invention, a hard disc is polished by using a polishing apparatus which comprises of a free-turning turntable, on which a disc is placed, and a polishing material which polishes the surface of the disc on the turntable by contacting thereto. The rotation of the turntable is induced by the rotation of the polishing material. The following polishing methods are employed to solve the above-mentioned problem of the prior art.

(1) The spindle of the polishing material is slightly inclined, and then the polishing pressure between the polishing material and the disc is deflected. Thereby, stable rotation of the disc is gained and the disc is polished uniformly.

(2) The hard discs are essentially grounded, the static electricity which is generated by friction is earthed, and thus polishing dust is prevented from sticking to the discs.

(3) To prevent frictional heat, a backing pad, having radiation function, is deposited onto the polishing material, and means for cooling the disc, such as air blowing, is provided.

(4) While polishing a disc, the rotation of the disc occasionally stops because of an equilibrium between the frictional force which gives rotation and the other frictional force which holds it back.

To prevent such stopping, the disc is rotated first, and then the polishing material is moved to cover the surface for polishing, avoiding the spot at which the two forces balance.

(5) To prevent discs from the above-mentioned stops by balance of the two forces, a polishing material having a diameter which is larger than the width of surface for polishing of a disc is employed, and a part of the polishing material protrudes from the edge of the disc to the outside.

(6) The temperature of the surface for polishing is observed while the disc is being polished. The polishing material is released from the disc when overheating occurs.

Further, application of the present invention is not limited to the polishing of resin optical discs, only.

Several other kinds of discs could be polished by using suitable polishing materials. Therefore, the invention is applicable for the polishing of metal wafers such as silicon or optical discs such as lenses.

Embodiments of the present invention is hereby described by referring the drawings.

Embodiment 1

Figure 1:
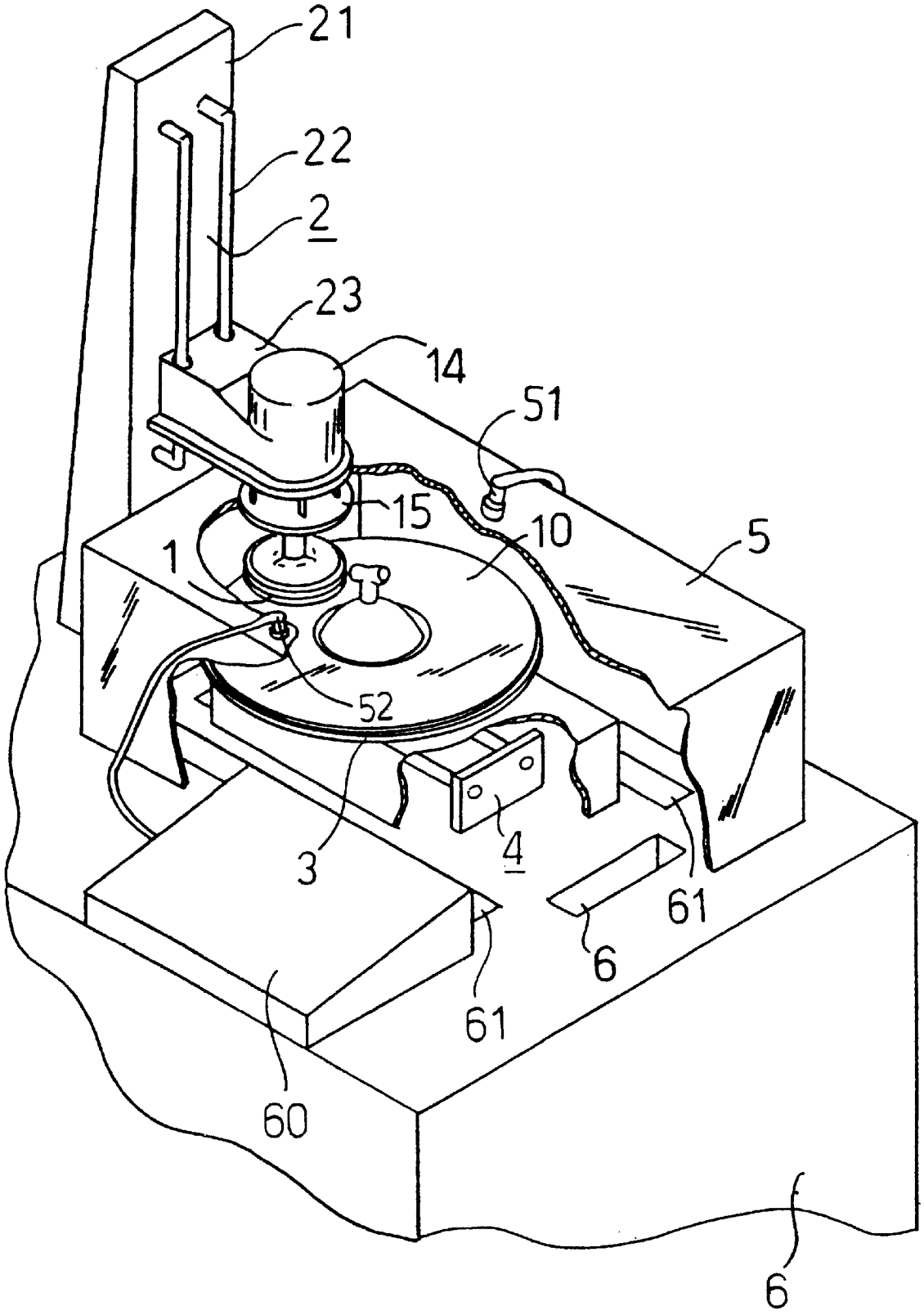
FIG. 1 is a partially cutaway view in fragmentary perspective of a polishing apparatus of the first embodiment.

As shown in FIG. 1, the polishing apparatus of Embodiment 1 comprises, a base 6, a turntable 3 which is mounted on the base 6, a sliding mechanism 4 which horizontally slides the turntable 3, a polishing pad 1 as a polishing material which contacts and polishes a disc 10 on the turntable 3, an up-down mechanism 2 which vertically moves the polishing pad 1, a dust cover 5 mounted on the base 6 and covering the turntable 3 and the polishing pad 1, a console 60 provided on a base 6 to control the polishing apparatus, and a temperature sensor 52 deposited on the dust cover 5 for detecting the surface temperature of the disc 10.

The up-down mechanism 2 comprises a cylinder base 21 standing on the base 6, two rodless cylinders 22 fixed on the side of the cylinder base 21, a polishing pad base 23 which is moved up and down by the rodless cylinder 22. The polishing pad base 23 is moved by compressed air from a compressor (not shown) and its movements are controlled by the console 60. The polishing pad base 23 has a motor 14 to rotate the polishing pad 1. A shutter 15 is fixed under the motor 14 to close a hole (not shown) which is provided on the dust cover 5 for the polishing pad 1 to move through.

Figure 2:
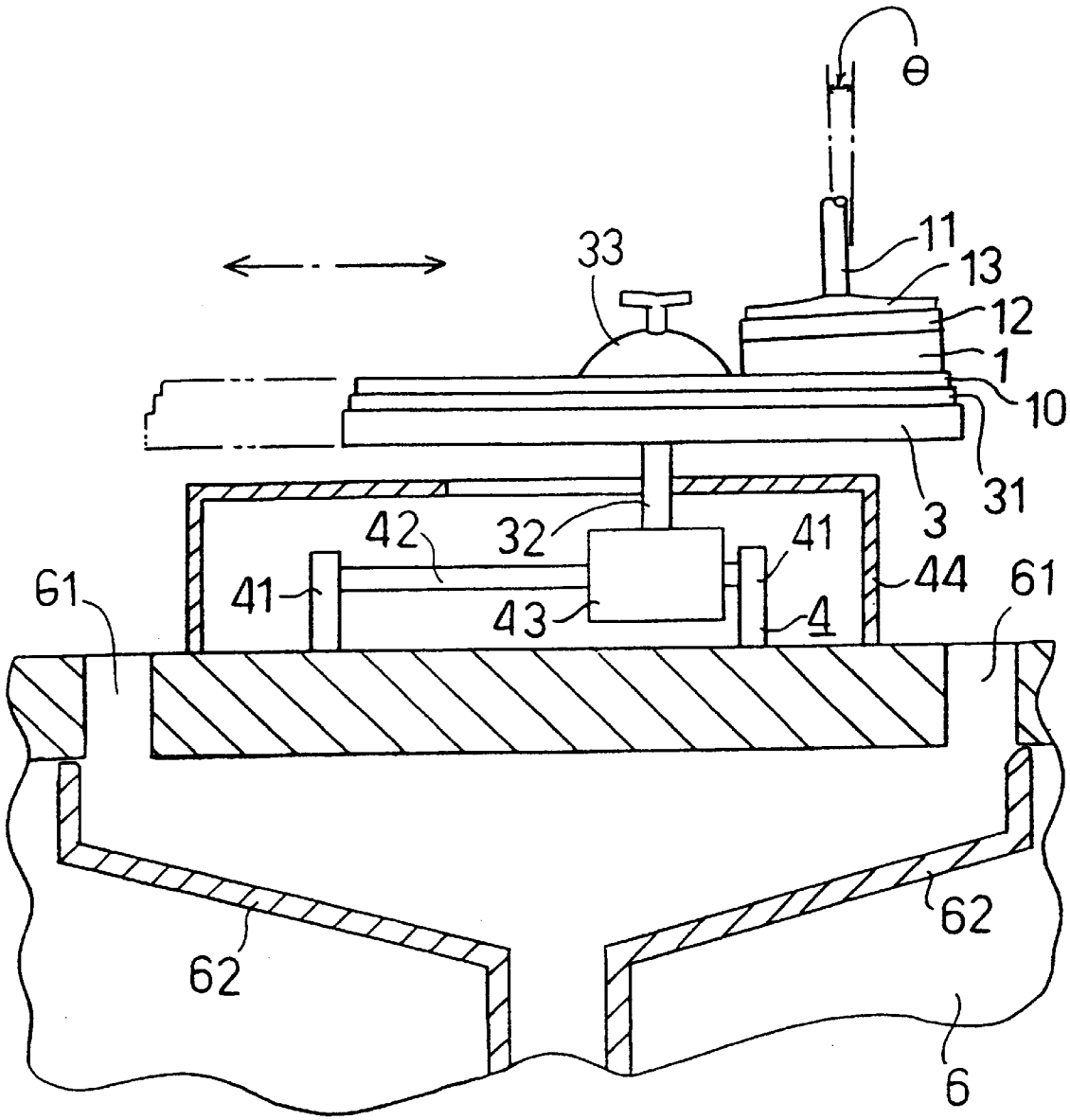
FIG. 2 is a fragmentary sectional side elevation of a polishing apparatus of the first embodiment.

As shown in FIG. 2, the polishing pad 1 is fixed on a spindle 11 inter-linked to the motor 14. A backing pad 12 and a rubber pad 13 are interposed between the spindle 11 and the polishing pad 1. The backing pad 12 is made of a porous soft resin. Thus, the backing pad 12 works as an absorbent and diffuses frictional heat of the polishing pad 1 heated by polishing.

The spindle 11 slightly inclines toward the center of the turntable 3 from the vertical axis of the disc 10. Its tilt angle is set at 0.5 to 5.0 degrees. A disc 10 is polished uniformly by such inclination of the spindle 11, the details of which are described later.

Figure 4:
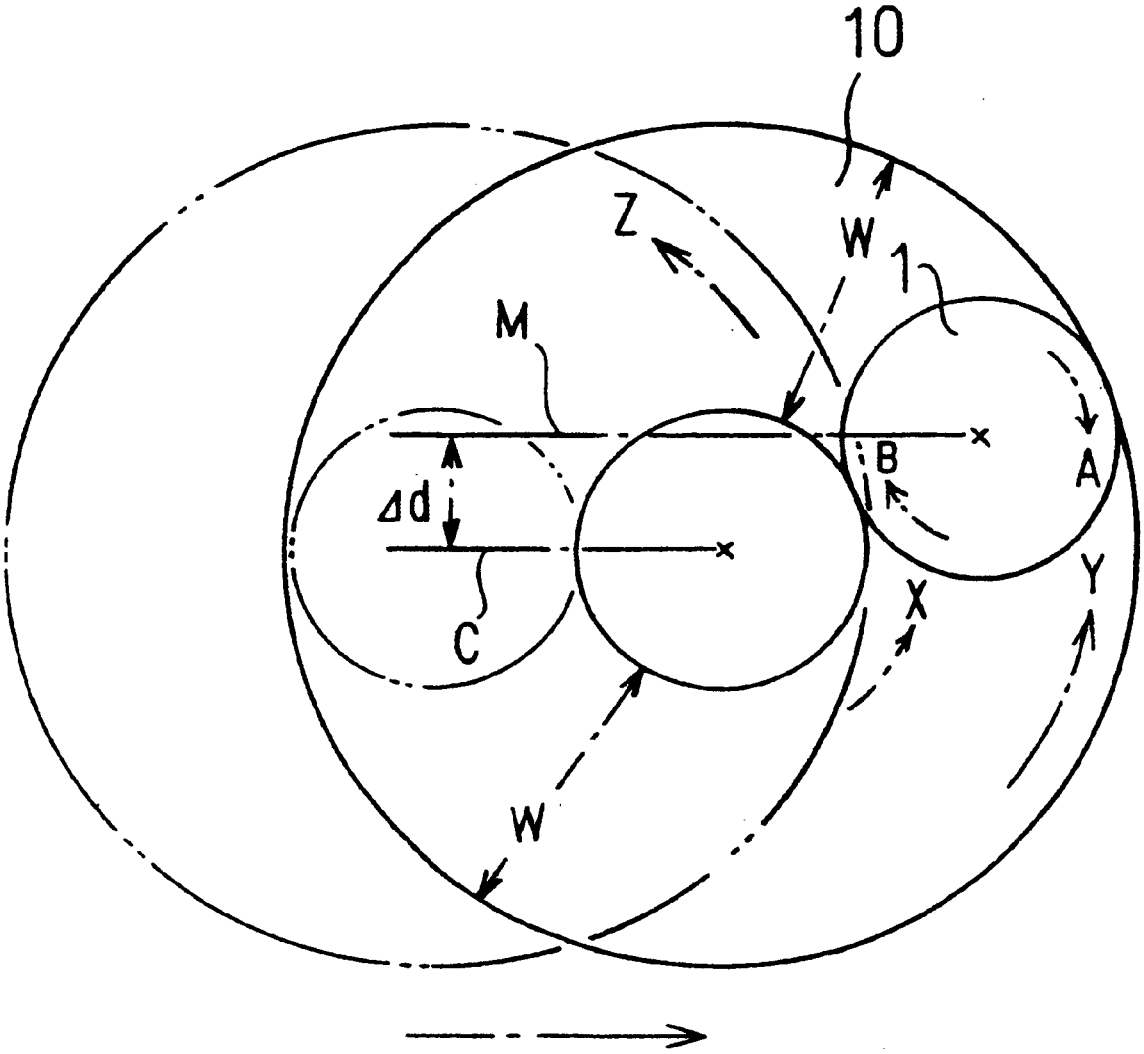
FIG. 4 is a schematic plan view, explaining the polishing method of the first embodiment.

As shown in FIG. 4, the line in which the spinning center of the polishing pad 1 moves on the disc 10 (hereinafter referred to as "the moving line M") is parallel and drifted from a line through the center of the disc 10 (hereinafter referred to as "the center line C). This is because if the spinning center of the polishing pad 1 were to move on the center line C, the frictional force which gives rotation and the other frictional force to hold it back would balance on a certain point, and then such an equilibrium would make the turntable 3 stop. If the turntable 3 were stopped, a part of the disc 10 would be polished deeply. To prevent such partial polishing, the moving line M of the polishing pad 1 is displaced from the center line C of the turntable 3. The displacement distance $\Delta d$ is preferably 30 to 50 mm, when a polishing material, having a 100 mm diameter, polishes 12 inch discs in its diameter.

The turntable 3 is rotatably pivoted on a shaft bearing 32. A conductive mat 31 is mounted on the turntable 3. The disc 10 is placed on the conductive mat 31 and is locked up on the turntable 33 by a lock cover 33. The lock cover 33 covers the label of the disc 10. The turntable 3 and other parts which are connected to the turntable are conductive.

Whereby, the disc 10 is essentially grounded via the conductive mat 31 and the turntable 3.

The sliding mechanism 4 comprises two rodless cylinders 42 which are held by two cylinder bases 41 standing on the base 6 and a sliding base 43 sliding along the rodless cylinders 42. The shaft bearing 32 of the turntable 3 is fixed on the sliding base 43. The sliding base 43 slides by compressed air from a compressor (not shown) and are controlled by the console 60. A dust cover covers the sliding mechanism 4 to prevent polishing dust from coming in.

As shown in FIG. 1, a vacuum intakes 61 are provided on top of the base 6, inside of the dust cover 5. As shown in FIG. 2, a vacuum nozzle 62 of vacuum cleaner (not shown), which is inside the base 6, is connected to the vacuum intakes 61. Polishing dust is ejected from the disc 10 by centrifugal forces and then the dust is drawn into the vacuum cleaner from the vacuum intakes 61.

The dust cover 5 is made of transparent resin, so that the polishing appearance can be observed. An air injector 51 is provided on the dust cover 5 to cool the disc 10 off. Compressed air is blown onto the surface of the disc from a compressor (not shown).

A temperature sensor 52 is fitted on the dust cover 5, behind the polishing position of the disc 10, i.e., an offset position from the polishing pad 1 in its rotating direction. The temperature information is managed in the console 60 and the polishing pad 1 is automatically raised from the disc when it overheats beyond the preset temperature. A deformation of the disc thereby is prevented.

An infra-red sensor is preferable as the temperature sensor 52, since such a sensor does not contact the disc and is highly sensitive.

Rotation information and the temperature limits have been set up in the console 60. When temperature information is inputted, the rotation of the polishing pad 1, the movement of the up-down mechanism 2, and the slide of the sliding mechanism 4 are automatically controlled by the information.

The operation of the apparatus of Embodiment 1 is hereby described.

Figure 3:
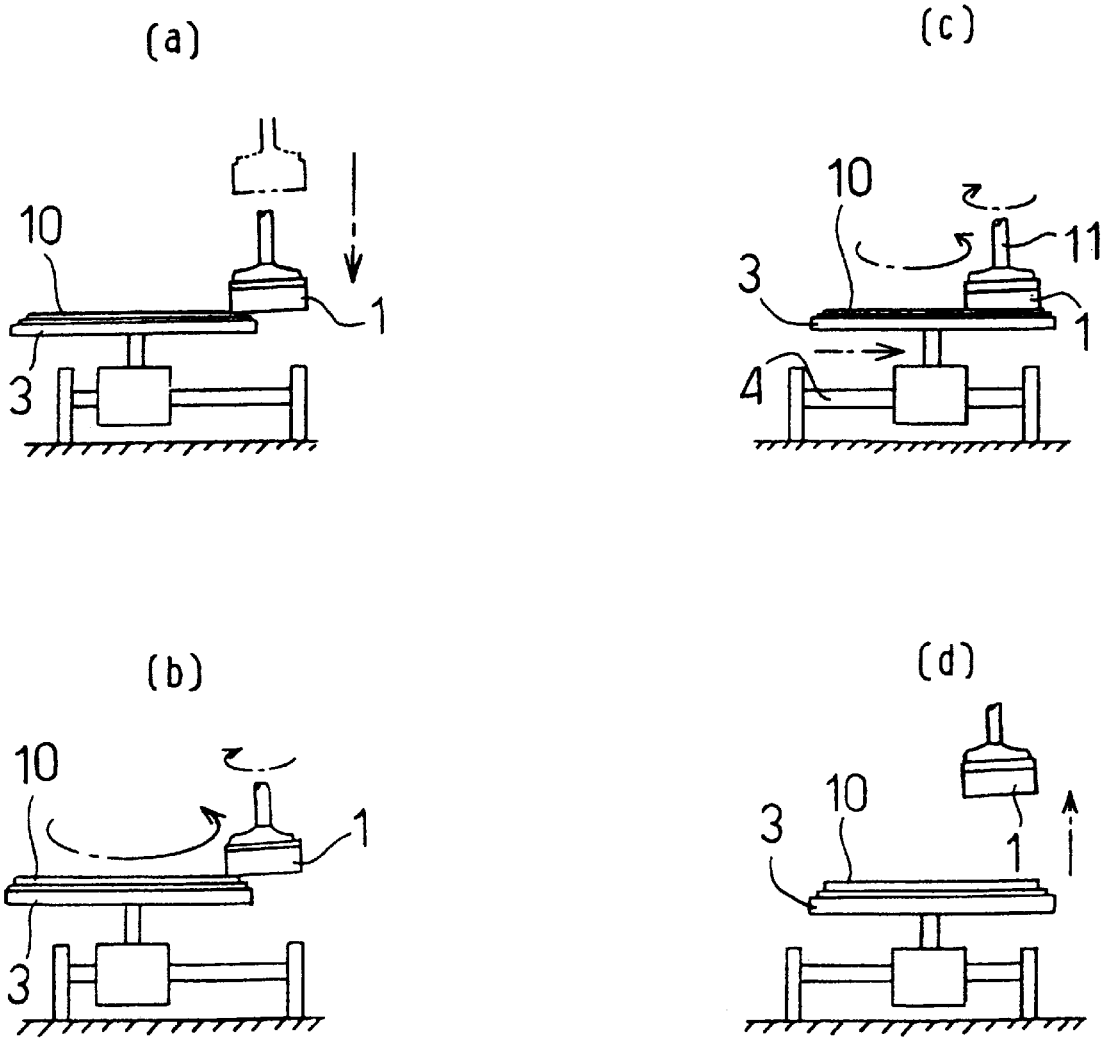
FIG. 3 is a schematic side view, explaining the polishing method of the first embodiment.

(1) The polishing pad 1 moves down and touches the disc 10. The turntable 3 positions the disc 10 so that its periphery touches the periphery of the disc 10 (refer FIG. 3-(*a*)).

(2) The polishing pad 1 is rotated by the motor 14, and then the turntable 3 starts to rotate in the direction (arrow Z of FIG. 4) opposite to the direction of the polishing pad 1 (arrow A of FIG. 4) because of the friction between the polishing pad 1 and the disc 10. In this case, the polishing pad 1 turns clockwise and the turntable 3 turns anti-clockwise (refer FIG. 3-(*b*) and FIG. 4).

(3) When the rotation is stabilized, the turntable 3 is slidden along the sliding mechanism 4 until the polishing pad 1 covers the surface for polishing of the disc 10, i.e., the polishing pad 1 polishes the disc 10 covering the width W. The spindle 11 slightly inclines in the manner that the polishing pressure on inside of the disc 10 is more than outside thereof. Therefore, the rotational moment on the inside is larger than that of the outside inside and then the initial rotating direction is kept (refer FIG. 3-(*c*) and FIG. 4).

(4) When polishing is completed or disc 10 is overheated, the polishing pad 1 is released from the disc 10. The turntable stops when the polishing pad 1 leaves, because the turntable is free-rotating, that is, no driving force is provided thereto. (refer FIG. 3-(*d*)).

The polishing method of Embodiment 1 is hereby described.

As shown in FIG. 4, referring Arrow B and Arrow X, the disc 10 turns in the same direction as the polishing pad 1 on the inside surface of the disc 10, and referring Arrow A and Arrow Y, the disc 10 turns in the opposite direction to the polishing pad 1 on the outside surface thereof. The polishing pressure on the inside surface is larger than the outside surface since the spindle 11 of the polishing pad 1 is inclined, and, thus, conditions with respect of frictional speed and polishing pressure on each sides surface are contrary to each other.

Accordingly, to obtain a high degree of even polishing, combinations, which are "slower frictional speed and higher polishing pressure" and "faster frictional speed and lower polishing pressure", are employed and its tilt angle are adjusted to make the polishing speeds of each side surfaces uniformly.

Although the turntable 1 slides in the above Embodiment 1, it is possible to achieve the same effects by employing a slideable polishing material and a turntable which is freely pivoted on a fixed spindle. Therefore, the same effect can be obtained where a turntable and a polishing material slide relative to each other.

Furthermore, it is possible to polish either an inside surface or an outside surface of the disc 10 more deeply, if necessary, since the tilt angle of the spindle 11 is controllable.

Embodiment 2

In the Embodiment 2, a polishing material having a diameter which is larger than the width of surface for polishing of a disc is employed to obtain stable rotation and even polishing of the discs. A part of such a polishing material protrudes from periphery of the disc 10*a*.

Figure 5:
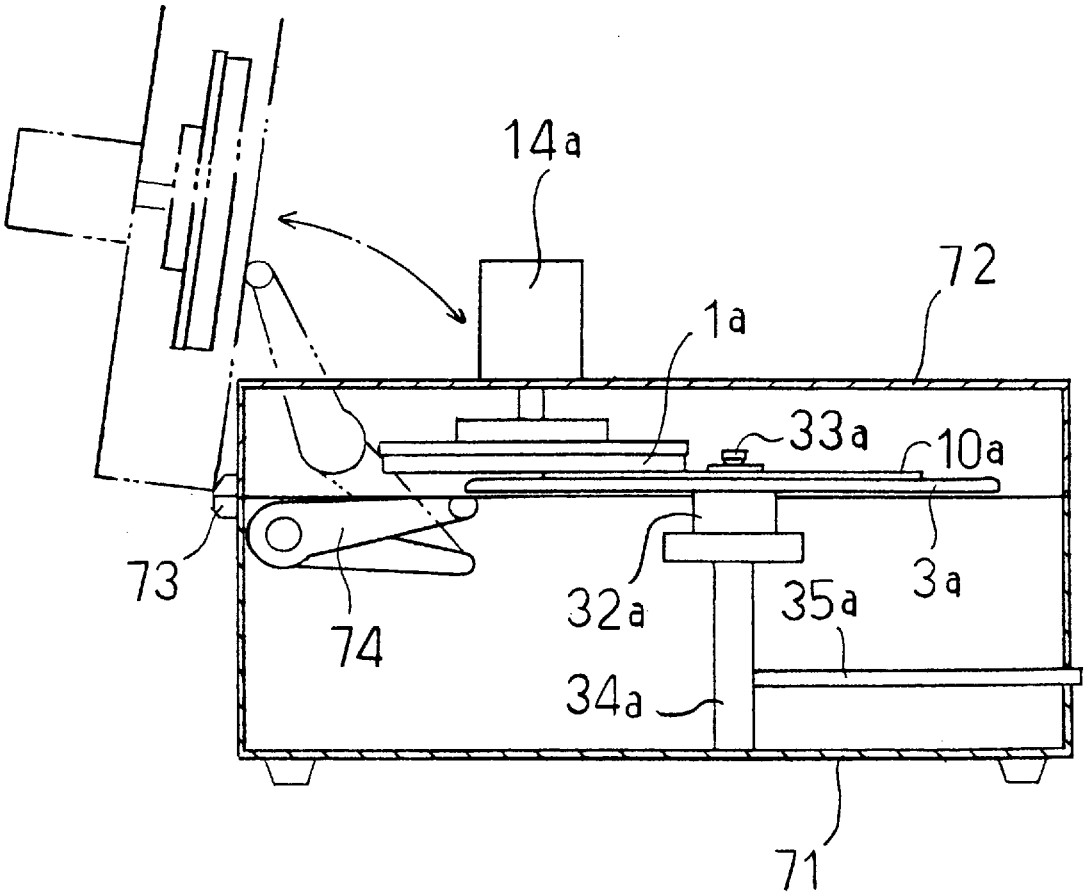
FIG. 5 is a sectional side view of the second embodiment.
Figure 6:
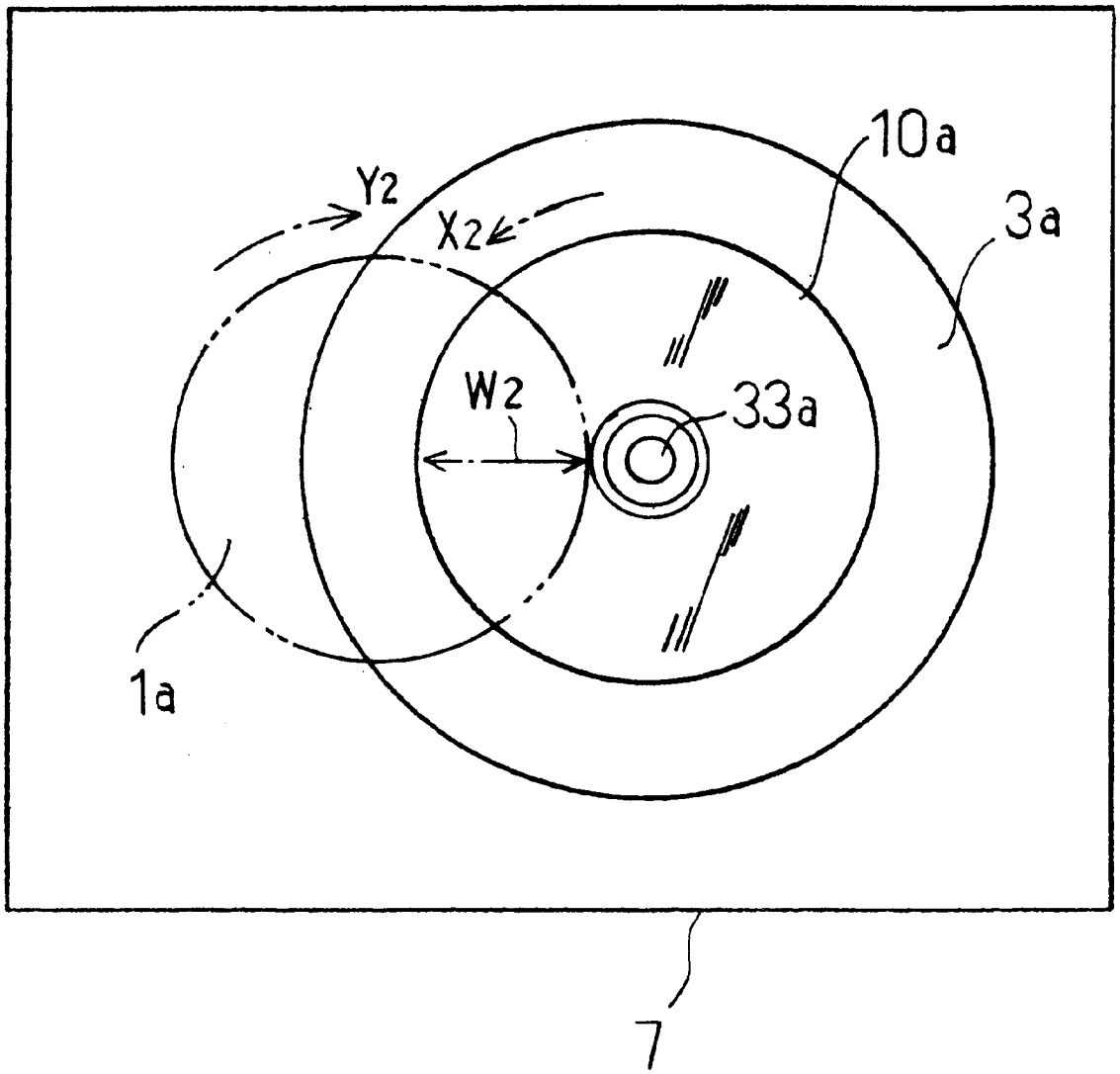
FIG. 6 is a plan view, explaining the polishing method of the second embodiment.

As shown in FIGS. 5 and 6, a polishing apparatus of the present embodiment comprises a case 7 including a box 71 and lid 72, a polishing pad 1*a* as a polishing material, a motor 14*a* which rotates the polishing pad 1*a*, and a turntable 3*a* which a disc 10*a* is put onto. The polishing pad 1*a* and the motor 14*a* are fixed on the lid 72. The turntable 3*a* is fixed in the box 71.

The lid 72 is hinged on the box 71, and held by an arm 74 while opening. The motor 14*a* is fixed on the lid 72 and the polishing pad 1*a* is inter-linked thereto. The polishing pad 1*a* shall be horizontal and contact with the disc 10*a* when the lid 72 is closed.

The turntable 3*a* is freely rotatable by a shaft bearing 32*a* and the shaft bearing 32*a* is mounted on the telescopic post 34*a*. Whereby, the pressure between the polishing pad 1*a* and disc 10*a* is adjusted by the up-down of the turntable 3*a*.

The disc 10*a* is secured on the turntable 3*a* by the lock cover 33*a*.

The polishing method of Embodiment 2 is hereby described.

As shown in FIG. 6, the polishing pad 1*a* covers width W2 of the disc 10*a* for polishing. The diameter of the polishing pad 1*a* is larger than the width W2. Thus, a part of the polishing pad 1*a* protrudes from an edge of the disc 10*a*. Especially, the radial of the polishing pad 1*a* is larger than the width W2. Whereby, the disc 10*a* receives uniform friction.

After adjusting the contacting pressure between the polishing pad 1*a* and the disc 10*a* by the height of the telescopic post 34*a*, the motor 14*a* starts to rotate the polishing pad 1*a*. The disc 10*a* should turn in the opposite direction Arrow X2 to Arrow Y2 of the polishing pad 1*a*. The disc 10*a* turns stably when the polishing pad 1*a* is properly pressed thereto. If not, the height of the telescopic post 34*a* is re-adjusted.

Accordingly, this polishing method prevents the disc 10*a* from an unexpected stopping which occasionally happens in the prior art.

Further, the polishing pad 1*a* horizontally contacts with the disc 10*a* and then uniform pressure is provided through the width W2 of the disc 10*a*. Furthermore, the disc 10*a* is evenly polished, because the polishing surface of the polishing pad 1*a* runs across the surface for polishing of the disc 10*a*.

Consequently, the present invention provides the following functions:

(1) The polishing speed over the surface for polishing is uniform and even polishing is obtained by employment of an inclination of spindle and a large polishing material.

(2) Polishing dust is prevented from sticking to the disc, since the frictional electricity which is generated on the disc is grounded.

(3) The disc is prevented from overheating by monitoring and controlling its temperature.

(4) The porous backing pad is disposed to the polishing material. Thus, heating of the polishing material is limited.

This invention relates to methods and apparatus for polishing hard discs including, but not limited to, resinous optical discs and silicon wafers, and is useful to obtain a high degree of uniform polishing thereof.

What is claimed is:

1. An apparatus for polishing hard discs comprising:

a turntable for placing a disc thereon, said turntable being freely rotatable and without any direct driving mechanism; and a polishing material for polishing a surface of said disc by contacting to said surface, said polishing material rotating about an axis perpendicular to the plane of said disc;

wherein said turntable is rotated by a force induced by the rotation of said polishing material.

2. An apparatus for polishing hard discs as defined in claim 1 further comprising a porous backing pad disposed between said polishing material and a spindle thereof.

3. An apparatus for polishing hard discs as defined in claim 1 or 2 further comprising a vacuum intake located underneath of outside of said turntable, and said vacuum intake is connected to a vacuum cleaner.

4. An apparatus for polishing hard discs according to claim 1 or 2 further comprising an air exhaust provided above said turntable, and air is blown from said air exhaust to a rotating surface of said disc, and whereby said disc is cooled off.

5. A method for polishing a hard disc comprising the steps of:

providing said hard disc on a turntable, said turntable being freely rotatable and without any direct driving mechanism;

positioning a polishing material for polishing a surface of said disc by contacting therebetween; and turning said disc in a direction opposite to a turning direction of said polishing material by a frictional force produced by contacting said disc and said polishing material, thereby inducing rotation of said turntable in a rotating direction of said disc by said turn of said disc, causing even and uniform polishing on the surface of said disc.

6. A method for polishing hard discs according to claim 5, wherein the tilt angle of said spindle of said polishing material is adjustable.

7. A method for polishing hard discs as defined in claim 5, wherein, when positioning said polishing material for polishing the surface of said disc, a spindle of said polishing material slightly inclines toward the center of said turntable from a vertical axis of said disc.

8. A method for polishing a hard disc comprising the steps of:

providing said hard disc on a turntable, said turntable being freely rotatable and without any direct driving mechanism;

positioning a polishing material for polishing a surface of said disc by contacting therebetween, wherein a periphery of said polishing material contacts with a periphery of said disc;

turning said disc in a direction opposite to a turning direction of said polishing material by the rotation of said polishing material, thereby inducing rotation of said turntable in a rotating direction of said disc by said turn of said disc; and relatively and horizontally shifting a surface contact area between said disc on said turntable and said polishing material for moving said polishing material on said disc to be polished while maintaining the initial turning direction of said turn table.

9. A method for polishing hard discs according to claim 8 wherein a spinning center of said polishing material slides on a line which is parallel with a line passing through the center of said disc.

10. A method for polishing hard discs as defined in claim 8, wherein, when positioning said polishing material for polishing the surface of said disc, a spindle of said polishing material slightly inclines toward the center of said turntable from a vertical axis of said disc.

11. A method for polishing a surface of a disc comprising the steps of:

placing a disc to be polished on a free rotating turntable which has no direct driving mechanism connected thereto;

positioning a polishing material which rotates about an axis substantially perpendicular to the plane of said disc and contacting a surface of said disc by an up-down movement between said polishing material and said disc;

polishing said disc by said polishing material having a diameter larger than a width of a surface of said hard disc to be polished by the rotation of said polishing material and by rotation of said turn table induced by the rotation of said polishing material through said disc.

12. A method for polishing a surface of a disc according to claim 11, wherein a radius of said polishing material is the same as or larger than said width of said surface to be polished, and said polishing material covers said surface to be polished and polishes said surface by turning said disc in a direction opposite to a turning direction of said polishing material.

13. An apparatus for polishing hard discs as defined in claim 1, wherein a spindle of said polishing material slightly inclines toward the center of said turntable from a vertical axis of said disc.

* * * * *